US006137449A

United States Patent [19]

Kildal

[11] Patent Number: 6,137,449

[45] Date of Patent: Oct. 24, 2000

[54] REFLECTOR ANTENNA WITH A SELF-SUPPORTED FEED

[76] Inventor: Per-Simon Kildal, Kullay 8, 43543 Molnlyeke, Sweden

[21] Appl. No.: 09/136,332

[22] Filed: Aug. 19, 1998

Related U.S. Application Data

[63] Continuation-in-part of application No. 08/718,989, Sep. 26, 1996, Pat. No. 6,020,859.

[60] Provisional application No. 60/056,220, Aug. 21, 1997.

[51] Int. Cl.[7] ..... H01Q 19/19

[52] U.S. Cl. ..... 343/781 P; 343/781 CA; 343/786; 343/840

[58] Field of Search ..... 343/781 CA, 781 R, 343/781 P, 785, 840, 786, 912, 771, 837, 872

[56] References Cited

U.S. PATENT DOCUMENTS

| | | | |
|---|---|---|---|
| 2,605,416 | 7/1952 | Foster | 343/781 P |
| 3,483,564 | 12/1969 | Glynn | 343/781 R |
| 4,306,235 | 12/1981 | Christmann | 343/781 P |
| 4,963,878 | 10/1990 | Kildal | 343/781 P |
| 6,020,859 | 2/2000 | Kildal | 343/781 CA |

*Primary Examiner*—Tan Ho
*Attorney, Agent, or Firm*—Pittenger & Smith, P.C.

[57] ABSTRACT

The invention consists of improvements of reflector antennas with self-supported feeds. The feed consists of a waveguide tube, a dielectric joint and a sub-reflector. The tube is attached to the center of the rotationally symmetric reflector and extends to the focal region of it. The sub-reflector is located in front of the tube, and the surface of this sub-reflector is provided with rotationally symmetric grooves also called corrugations. The improvements of the present invention are (1) a ring focus reflector to improve the gain of the antenna, (2) an elevated central region of the reflector to reduce the return loss, (3) metal screws or cylinders to strongly fasten the sub-reflector to the tube, (4) corrugations or other similar means around the rim or the reflector in order to reduce far-out sidelobes, (5) dual-band operation by means of a coaxial waveguide outside the circular waveguide in the tube, and (6) dielectric filling or covering of the corrugations or of the region between the corrugations and the waveguide tube end, both in order to avoid the gathering of water, dust or other undesired material in this area which could destroy the performance of the antenna.

31 Claims, 11 Drawing Sheets

REFLECTOR ANTENNA WITH A SELF-SUPPORTED FEED

This application claims the benefit of U.S. provisional patent application No. 60/056,220, filed Aug. 21, 1997, which is a continuation-in-part of Ser. No. 08/718,989 filed Sep. 26, 1996 now U.S. Pat. No. 6,020,859, issued Feb. 1, 2000.

FIELD OF THE INVENTION

The invention consists of improvements to reflector antennas with self-supported feeds of the types described in European Patent EP 87903452.8 publ no 0268635, U.S. Pat. No. 4,963,878 and U.S. Pat. No. 6,020,859, for the transmission or reception or both of electromagnetic waves. The antennas are principally intended for the use in radio link systems between base stations for mobile communications, but also in other applications such as e.g. microwave level gauging systems.

BACKGROUND OF THE INVENTION

Reflector antennas with self-supported feeds are chiefly used because they are straightforward and inexpensive to manufacture. They also provide higher antenna efficiency and lower side lobes in the radiation pattern than is the case when the feed has to be supported by diagonal struts. The drawback with the latter configuration is that the main reflector becomes blocked by the struts. A self-supported feed is also easily accessible from the back of the reflector, thus is frequently selected when it is best to locate the transmitter and/or the receiver there. This also reduces the loss that otherwise occurs when the electromagnetic waves have to be led in a cable along one of the support struts.

The European Patent EP 87903452.8 publ no 0268635, U.S. Pat. No. 4,963,878 and U.S. Pat. No. 6,020,859 describe different versions of reflectors with self-supported feeds, where the feed consists of a waveguide tube, a dielectric joint and a sub-reflector. The tube is attached to the center of the rotationally symmetric reflector and extends to the focal region of it. The sub-reflector is located in front of the tube, and the surface of this sub-reflector is provided with rotationally symmetric grooves also called corrugations. By these means the electromagnetic waves are prohibited from propagating along the sub-reflector surface independent of whether the electric field is normal to the surface or is tangential to it. The result is that the radiation pattern has higher directivity, lower spillover and lower far out sidelobes than otherwise would be possible.

The present invention relates to several improvements of the antennas described in European Patent EP 87903452.8 publ no 0268635, U.S. Pat. No. 4,963,878 and U.S. Pat. No. 6,020.859. The improvements are for improved readability in the below description denoted: ring focus reflector, elevated central region, metal screws, rim corrugations, simple tube dual band and feed protection.

Ring Focus Reflector

The antennas described in the above referenced European and U.S. patents and U.S. patent application make use of a main reflector which is rotationally symmetric and has a substantial parabolic shape. However, the antenna will have higher gain if the main reflector shape is improved. The present invention describes how to improve the shape of the main reflector.

Elevated Central Region

It is not possible to design the antennas in the above referenced European and U.S. patents and U.S. patent application with low reflection coefficient at the waveguide input. The reason for this is reflections from the region around the tube in the center of the main reflector. In the improvement of the antenna this problem is solved by modifying the reflector in its central region.

Metal Screws

In the above referenced European and U.S. patents and the U.S. patent application the sub-reflector is supported to the end of the waveguide tube by means of a dielectric joint, which partly or totally fills the gap between the sub-reflector and waveguide tube end, and which is interlocked with and glued to the sub-reflector and waveguide tube end. This gluing does not provide a sufficiently strong mechanical support in all applications. In the present invention this is improved for linearly polarized applications by means of metal screws or thin cylinders or plates which provide a strong metal connection between the sub-reflector and the end of the tube.

Rim Corrugations

In the above referenced European and U.S. patents and the U.S. patent application there will be large back-lobes in the direction opposite to the main lobe. The invention reduces these lobes by means of one or more corrugations or grooves or metalized dielectric rings around (or in the structure behind) the rim of the reflector.

Simple Tube

In the previous embodiments of the referenced European and U.S. patents the waveguide support tube has an inner diameter which changes near the end of the tube which is closer to the sub-reflector, and in some cases it was also necessary to insert one or more irises into this end of the tube, all in order to properly match the antenna to obtain a low reflection coefficient. The present invention describes an improvement by which the waveguide tube can be a circular cylindrical tube of constant cross-section along its length. This improvement significantly reduces manufacturing cost.

Dual Band

In the above referenced European and U.S. patents and the U.S. patent application, the antenna is fed through a circular waveguide for operation in a single frequency band of up to 20% bandwidth. In some applications dual band operation is of interest, e.g. one band for transmission and another for reception of signals. The invention describes a modified antenna which is fed by two waveguides; one inner circular waveguide and outside this a coaxial waveguide.

Feed Protection

In some applications the antenna may be located in hostile environments, and water, dust and other undesired material may gather in the region between the end of the tube and the sub-reflector and thereby destroy the performance. The present invention describes how the antenna in the above referenced European patent can be improved to be less sensitive to such effects.

SUMMARY OF THE INVENTION

Ring Focus Reflector

The present invention improves the main reflector shape of a parabolic antenna in three possible ways which below are denoted methods a, b and c:

a) The present invention utilizes the phase of the computed aperture field of the complete antenna with a paraboloidal main reflector. This aperture field is the field in a plane normal to the radiation axis in front of the main reflector. The phase of this copolar aperture field is studied by modern numerical methods by a complete numerical electromagnetic analysis of the aperture field of the complete antenna with a paraboloidal main reflector, and an optimum reflector which makes the phase constant is designed. The reflector shape is determined by the equation $$r(\theta) = \frac{2F}{(1+\cos\theta)} + \frac{\varphi(\theta)-\varphi(0)}{360(1+\cos\theta)}\lambda$$

where $\phi(\theta)$ is the phase in degrees of the computed copolar aperture field in the 45 deg plane in a paraboloidal reflector, F is the focal length, $\lambda$ is the wavelength, $r(\theta)$ is the radial distance from the focal point to the point on the main reflector, and $\theta$ is the angle between the symmetry axis and the line between the focal point and the point on the reflector.

b) The present invention utilizes the phase of the computed radiation field of the feed. The radiation field function of the feed, i.e. the sub-reflector when this is located in front of the end of the tube, is determined by modern numerical methods which can include the effect of the tube and the dielectric joint between the tube and the sub-reflector. In this computation the main reflector is not present so it is simpler to perform than the analysis in method a. From the phase of the radiation field of the sub-reflector the optimum main reflector shape can be determined. The equation is the same as for method a, but with $\phi(\theta)$ being the phase in degrees of the computed copolar radiation field in the 45 deg plane of the sub-reflector with tube and joint.

c) The present invention uses the formula of a ring focus reflector. The optimum reflector resulting from both above methods a and b satisfies to a very high accuracy the formula of a ring focus paraboloid, which is $$z = -F + \frac{1}{4F}(\rho-\rho_0)^2$$

where z is the axial coordinate along the symmetry axis (i.e. the z-axis) when there is no vertex plate, $\rho$ is the cylindrical radial coordinate measured from the z-axis, F is the focal length, and $\rho_O$ is the ring focus radius which is typically between 0.5 and 1.5 times the radius of the waveguide tube and is fixed between 0.2 and 0.6 wavelengths depending on the dimensions of the sub-reflector and tube and on the depth of the main reflector. The optimum parameter $\rho_O$ can be calculated from the phase of the radiation field function of the feed or from the phase of the aperture field, and it is different in different frequency bands and for different dimensions of the feed. Therefore, if the same reflector is used in several frequency bands, the reflector cannot be optimum in all bands. When the reflector shall be used in several frequency bands, the best shape of the reflector is obtained by optimizing it as explained above at the frequency which represents the geometrical mean of the overall lowest and overall highest frequency. Thus, if the lowest frequency is 21.2 GHz and the highest 40 GHz, the main reflector should preferably be optimized at 30.6 GHz. Then, for this example, the reduction in the aperture efficiency due to phase errors will be less than typically 0.15 dB at 21.2 GHz and 39 GHz and less than 0.05 dB at the design frequency 30.6 GHz. In a paraboloidal reflector the reduction is about 1 dB in all bands.

The optimum reflector as determined from the above methods a, b or c is very similar to a best fit standard paraboloid, with a maximum difference from it of typically up to 0.25 wavelengths. In most cases, the main reflector deviates from the ring focus paraboloid formula due to finite tolerances and different design methods by up to an RMS value of about 0.02 wavelengths. The differences are larger when the reflector is deep than when it is shallow. Deep reflectors are for applications which require low sidelobes. The optimum reflector is more flat in the center than the best fit parabolic reflector. Even if the differences are small, the gain of the antenna is typically between 0.2 and 1 dB larger when the reflector is optimized according to methods a, b or c, where the low number is for shallow reflectors and the high number for deep reflectors. Such ring focus reflectors are needed when using self-supported feeds, and not when using conventional primary feeds which are supported by diagonal struts. The reason is that the axial support tube of the former makes the phase fronts of the radiation from the feed ellipsoidal rather than spherical.

Elevated Central Region

The invention also provides an improved antenna with a low reflection coefficient at the waveguide input, obtained by modifying the reflector in its central region. The central region around the support tube is elevated compared to the original paraboloidal or ring focus shape. The central elevated region can be realized in several ways as described below.

It may be made as a separate reflecting (e.g. metal) plate around the tube, or it may be integrated with the foot of the selfsupported tube, or it may form a central part of the reflector surface itself. The elevated region has an outer diameter of typically between 1.9 and 7.0 wavelengths when the reflector diameter is between 30 cm and 120 cm in frequency bands between 7 and 40 GHz. The elevated region can be flat, or it can have a constant height over the unperturbed reflector. The maximum height of the elevated region over the unperturbed reflector is typically between 0.10 and 0.25 wavelengths. The central elevated region of the reflector may have sharp corners at its rim, or it may be tapered off gradually to zero wavelengths. If the elevated region is tapered off, the diameter of the elevated region between the points where the height is reduced to 0.37 of its maximun value is also typically 1.9 and 7.0 wavelengths depending upon the frequency and focal length of the reflector.

It is also possible to realize the elevated region by using a dielectric plate, in which case the thickness of the plate will be different from the metal case. The dielectric plate must be designed to provide a phase difference of the reflected waves leaving its surface relative to those reflected from the reflector itself of typically between 70 and 180 deg.

The central elevated region of the main reflector will increase the sidelobes of the antenna. This effect can be reduced by profiling the height of the elevated region. A Gaussian profile gives particular low sidelobes. This follows approximately the formula $$\Delta z = \Delta z_O e^{-(\rho-\rho_i)^2/\rho_g^2}$$

where $\Delta z$ is the central correction to the z-coordinate of the reflector (i.e. the height profile of the elevated region), $\Delta z_O$ is the maximum correction in the center, $\rho$ is the radial coordinate as before and varies between the radius of the tube and an outer maximum limit, $\rho_i$ is a number which can be anything between zero and the tube radius, and $\rho_g$ is the Gaussian width of the elevated central region, i. e. the width at which $\Delta z$ has decreased to 1/e=0.37 times the value of $\Delta z_O$. The Gaussian elevated region may either be made of reflecting material such as metal, or of dielectric material, in the same way as described above. The optimum thickness at the center is in the case of the Gaussian profile larger than for the constant thickness case.

If the reflector is used in several frequency bands, the dimensions of the elevated central region will be different in each band. Therefore, the central region of the reflector will normally be interchangeable in the same way as the waveguide tube and sub-reflector.

Metal Screws

In the present invention the fastening of the sub-reflector to the end of the tube is improved for linearly polarized applications by means of metal screws or thin metal cylinders or thin plates which provide a strong metal connection between the sub-reflector and the end of the tube. The metal screws or cylinders are located in the H-plane of the antenna, on either side of the symmetry axis, in such a way that they do not cause field blockage and thereby the radiation pattern and reflection coefficient at the waveguide input are not significantly affected. The screws, cylinders or plates are mounted to the waveguide tube by holes in its narrow end wall. This improvement destroys the rotational symmetry of the antenna and is only possible in linearly polarized applications.

Rim Corrugations

The invention reduces the far-out sidelobes of the antenna and in particular the lobes in the backwards direction by means of one or more corrugations or grooves or metalized dielectric rings around (or in a structure behind) the rim of the reflector. The grooves and dielectric rings can often be integrated with the support of a protecting dielectric sheet referred to as a radome in front of the reflector.

Simple Tube

In the previous embodiments of the referenced European and U.S. patents the waveguide support tube has an inner diameter which changes near that end of the tube which is closer to the sub-reflector, and in some cases it is also necessary to insert one or more irises into this end of the tube, all in order to properly match the antenna to obtain a low reflection coefficient. The invention describes an improvement by which the waveguide tube can be a circular cylindrical tube of constant cross-section along its length. This improvement significantly reduces manufacturing cost.

Dual Band

In the present invention, dual-band operation is obtained by designing the tube in such a way that it contains two waveguides: an inner circular waveguide surrounded by a coaxial waveguide. The circular waveguide is used for the higher frequency band and supports the TE11 circular waveguide mode as in the referenced patents. The coaxial waveguide is used for the lower frequency band and supports the TE11 coaxial waveguide mode. The former is the lowest order basic mode, whereas the latter is not, as a coaxial line can support a TEM mode with no lower cut-off. The TEM mode is undesirable and prohibited from propagation on the line by proper excitation of the TE11 mode only, and in other ways. The center of the sub-reflector, corrugations, the end of the tube near the sub-reflector and the dielectric joint are designed in order to give a good radiation pattern in both frequency bands. There are several geometries possible. The sub-reflector may be provided with corrugations of different depths in order to work properly as desired in both frequency bands. The shallowest corrugations should be between 0.25 and 0.5 wavelengths deep in the higher frequency band, and the deeper corrugations should be between 0.25 and 0.5 wavelengths deep in the lower frequency band.

Feed Protection

In the invention the sensitive region between the end of the tube and corrugations and the corrugations themselves are completely or partly filled by dielectric material, so as to protect them from gathering of water, dust or other undesired material which may destroy the performance. The invention may also be used for antennas in kind environments because the performance of the improved antenna is not necessarily worse in other respects than a standard antenna according to the referenced European and U.S. patents.

BRIEF DESCRIPTION OF THE DRAWINGS

The present invention will be explained in more detail by making reference to the drawings, where.

DETAILED DESCRIPTION OF THE DRAWINGS

Figure 1:
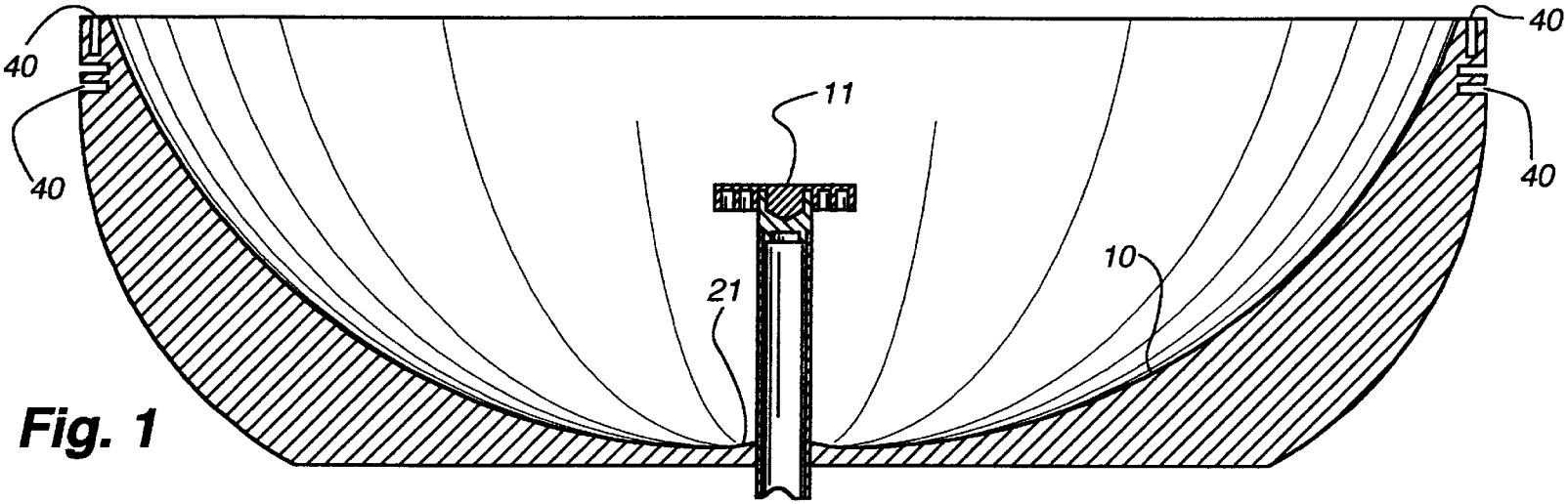
FIGS. 1 and 2 show axial cross-sections of two examples of reflector antennas.
Figure 2:
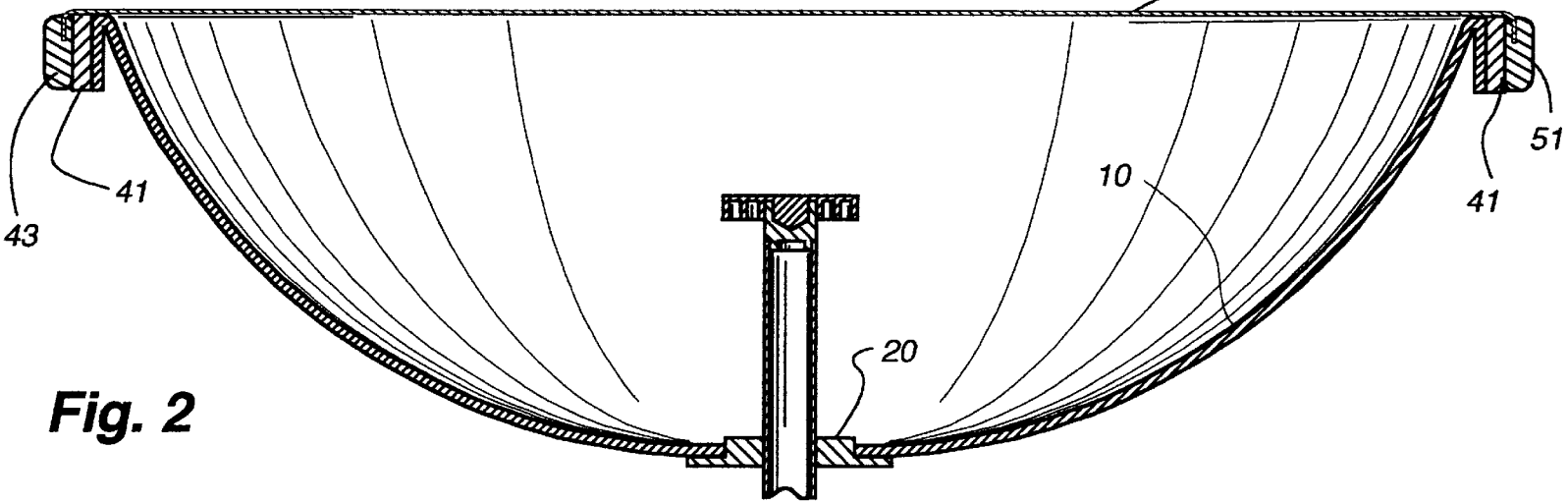

The antennas in FIGS. 1 and 2 consist of a main reflector 10. In the middle of this there is a self-supporting tubular feed element 11. The central region of the main reflector is elevated with a Gaussian shape 21 in FIG. 1 and a constant height 20 in FIG. 2. The main reflector in FIG. 1 is realized by a massive piece of sheet metal and the rim of the reflector 10 is provided with three grooves 40 according to the invention. There can be one groove around the actual rim, and two more at the side of the reflector structure. Each groove is separately as well as combined with the other embodiments of the invention. The reflector 10 in FIG. 2 is made from a.thin metal plate where the outer edge region is curved sharply backwards to form a flange, in order to stiffen the reflector. Radome 50, a thin dielectric sheet, is located in front of the reflector 10 and fastened to its rim by means of a metal ring 51 and hooks which are not shown in the drawing. Between the metal ring 51 and the reflector flange there is a metalized dielectric sheet curved to a ring 41 around the rim according to the invention. The dielectric ring is metalized on the outer side, and may or may not be metalized on the bottom and inner side.

Figure 3:
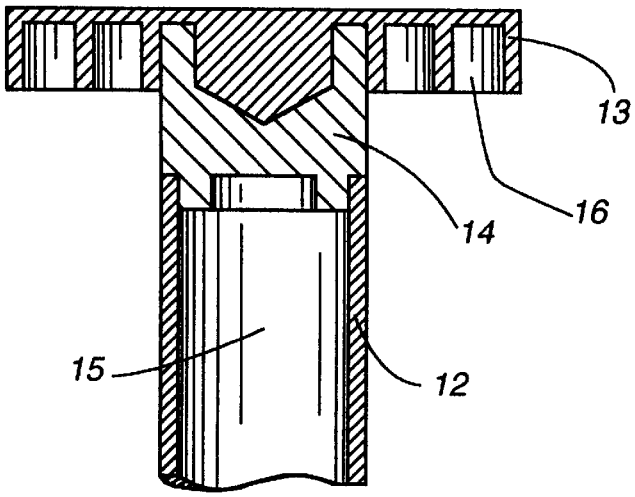
FIG. 3 show axial cross-sections of examples of feeds.

The feed in FIG. 3 consists of a cylindrical tube 12, and a sub-reflector 13. The inner surface of the tube 12 forms a circular cylindrical waveguide 15. The waveguide is designed to propagate the basic TE11 mode. The waveguide must have a larger diameter than 0.6 (approx.) wavelengths and be smaller then 1.2 (approx.). The tube 12 and the waveguide 15 are mostly made of conducting materials. The surface of the sub-reflector has at least one circular corrugation 16 in it, according to the referenced European and U.S. patents. These air-or dielectric-filled corrugations ensure that the electromagnetic waves are prohibited from propagating along the surface, regardless of whether the electric fields are normal to the surface or are tangential to it. This is important in order to achieve low sidelobes. The diameter of the sub-reflector is always larger than the diameter of the tube 12. There is a gap 14 between the sub-reflector and the end of the waveguide 15. The gap 14 is partly or totally filled with dielectric matter. Though this is necessary to attach the sub-reflector to the tube 12, this is also a means of controlling the radiation characteristics and impedance match.

Figure 4:
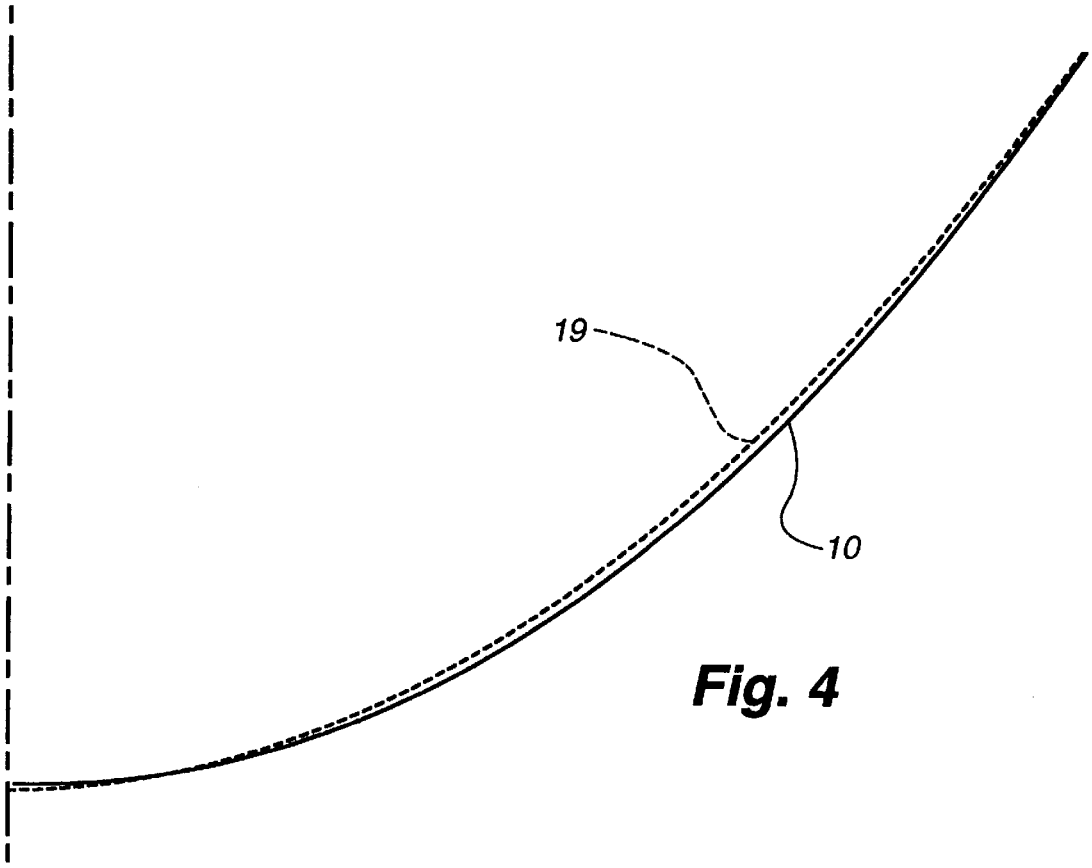
FIG. 4 shows the right side of the axial cross-section of an optimized ring focus reflector; and a standard point focus reflector.

The optimum ring focus reflector 10 in FIG. 4 is seen to be flatter in the bottom than the standard paraboloid 19. The two reflectors have been adjusted to each other in such a way that they coincide at the edge and that the focal point of the paraboloid lies in the same plane normal to the axis as the focal ring of the ring focus paraboloid. This makes the focal length of the ring focus paraboloid slightly shorter than that of the paraboloid, as illustrated.

Figure 5:
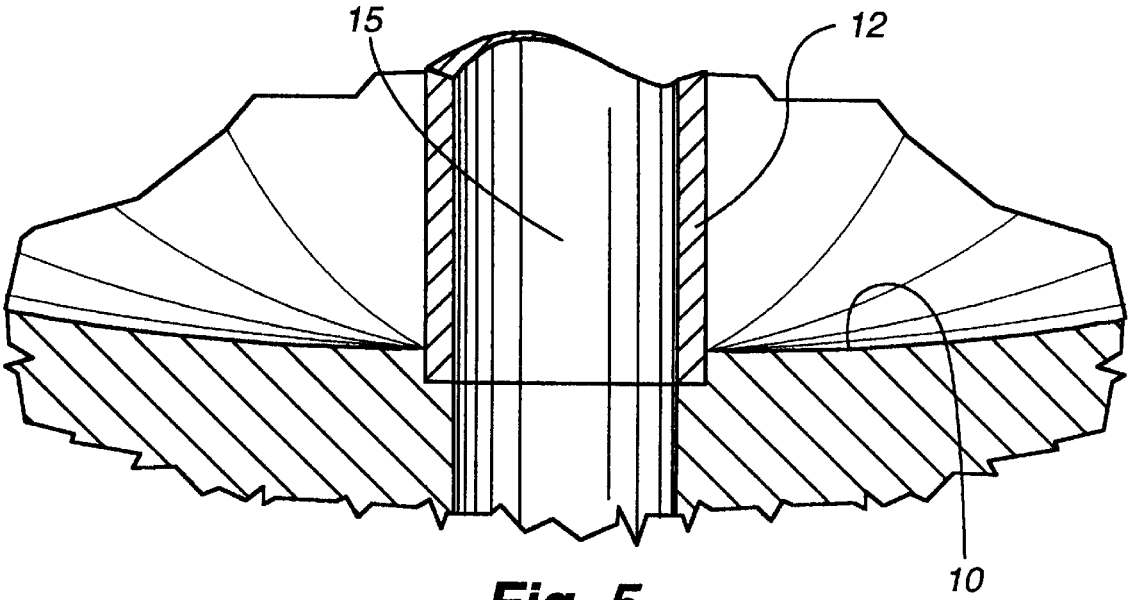
FIGS. 5–8 show an axial cross-section of the antenna in the center of the main reflector with no elevated central region (5), with an elevated region of constant height (6), with a Gaussian elevated region (7), and a comparison of the three different cases in the same drawing (8), with the elevated regions profiled.
Figure 6:
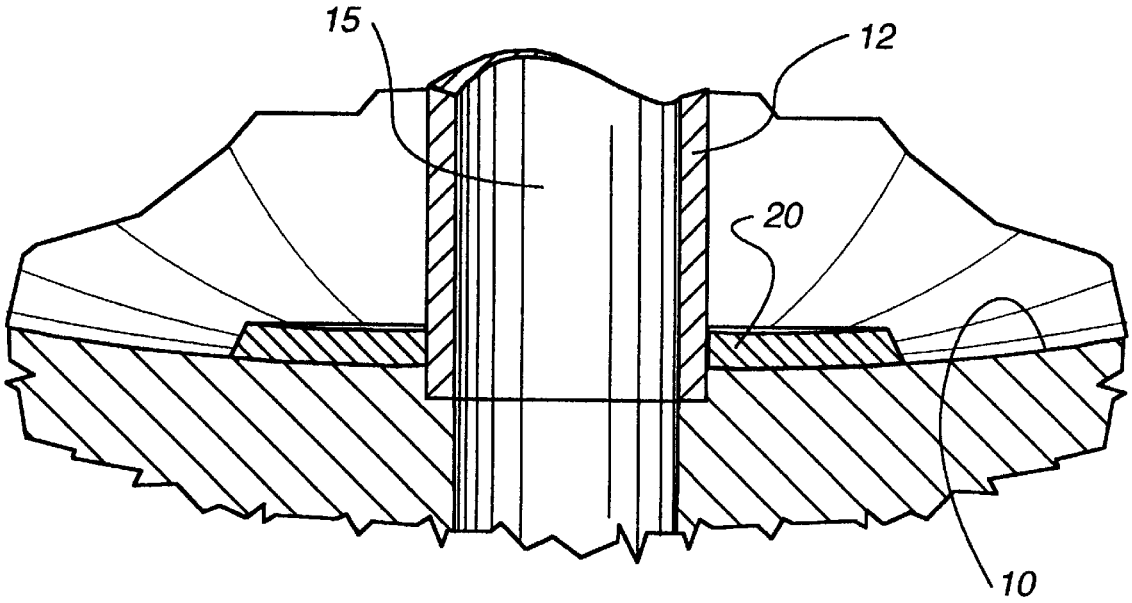
Figure 7:
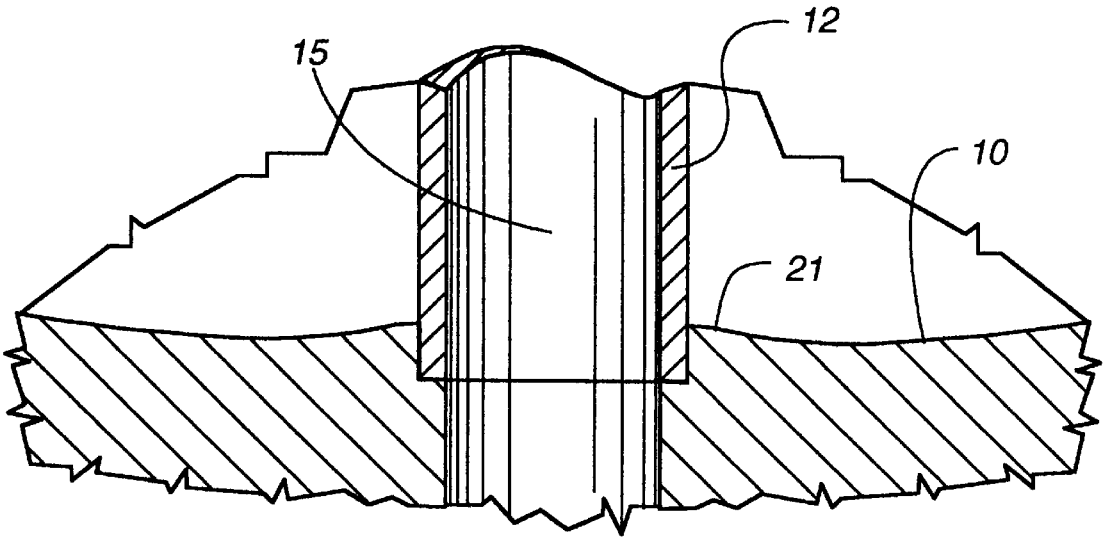
Figure 8:
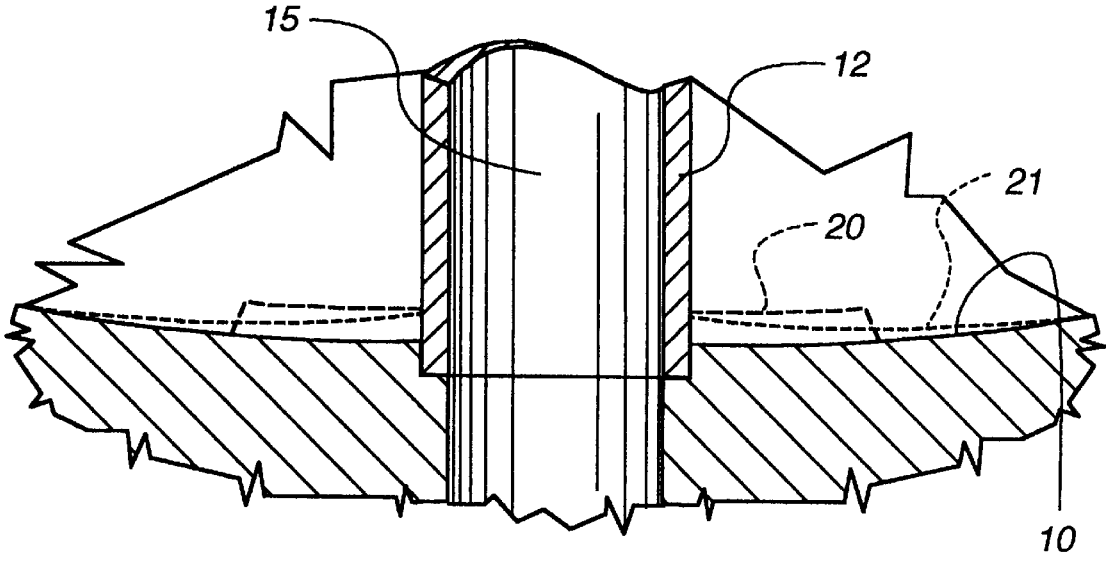

FIG. 5 shows a main reflector 10 without an elevated region in the center, whereas FIGS. 6 and 7 show two different elevated regions. The elevated region in FIG. 6 is clearly recognized as a plate 20 with constant height over the original reflector shape. FIG. 7 shows an example of a Gaussian height profile 21. The elevated region is not so visible as in FIG. 6, but becomes much more visible when plotting the three profiles in the same diagram, as shown in FIG. 8. The maximum of the Gaussian profile occurs at the symmetry axis and is therefore not actually present due to the central hole. Both FIGS. 6 and 7 show elevated regions according to the invention, but it should be understood that the invention is not limited to these height profiles. In particular, the Gaussian profile can be shifted by varying the parameter $\rho_r$.

Figure 9B:
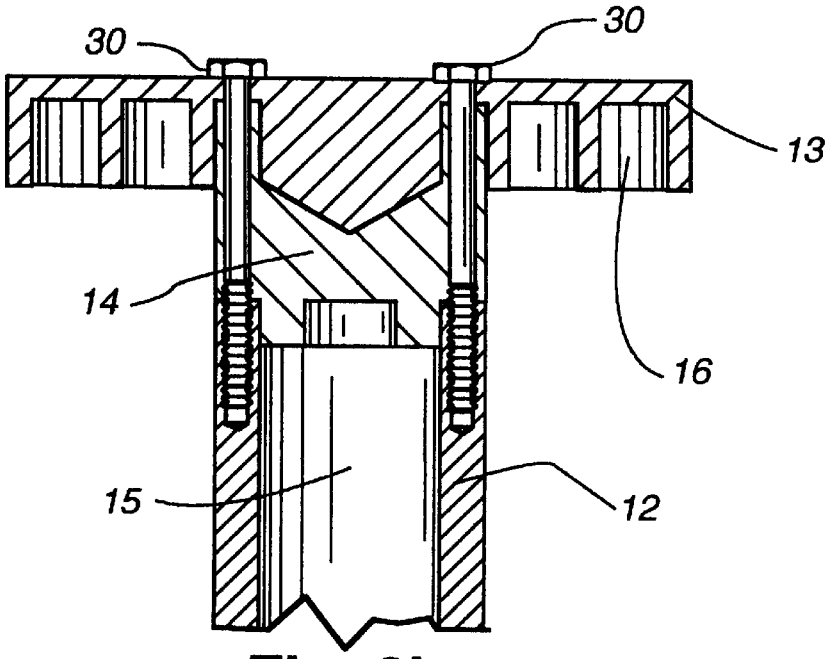
FIG. 9*a* is a top plan view and 9*b* is a cross-sectional view taken along lines 5—5 showing an axial H-plane cross-section of the sub-reflector and tube when the sub-reflector and tube are connected with two metal screws.
Figure 9A:
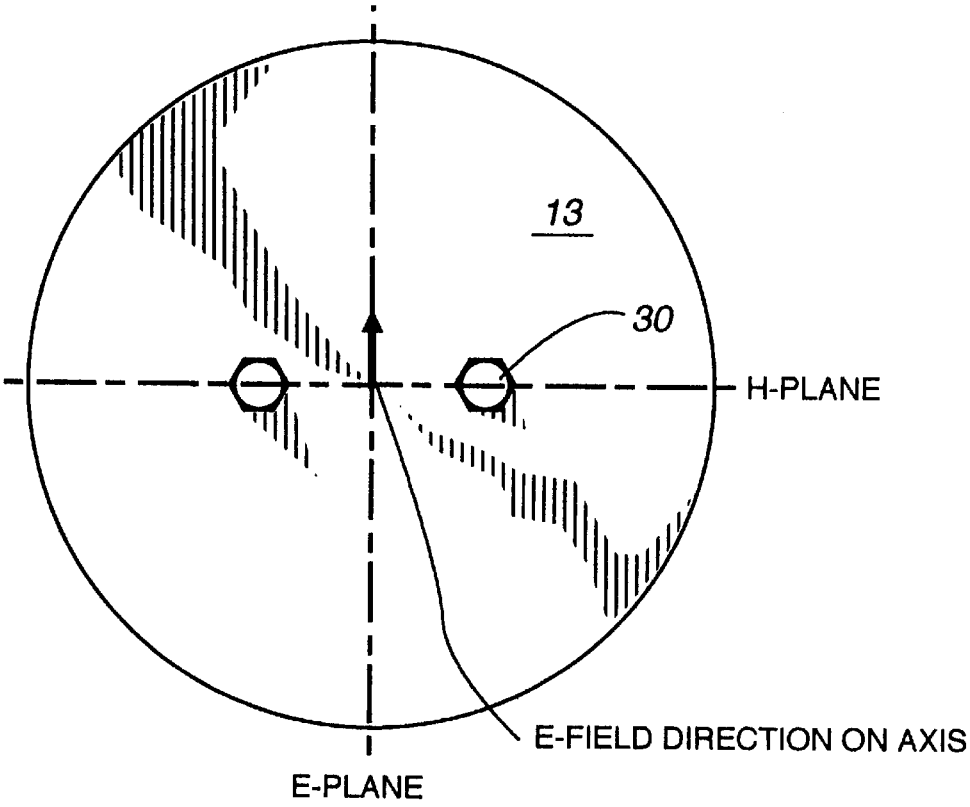
Figure 10B:
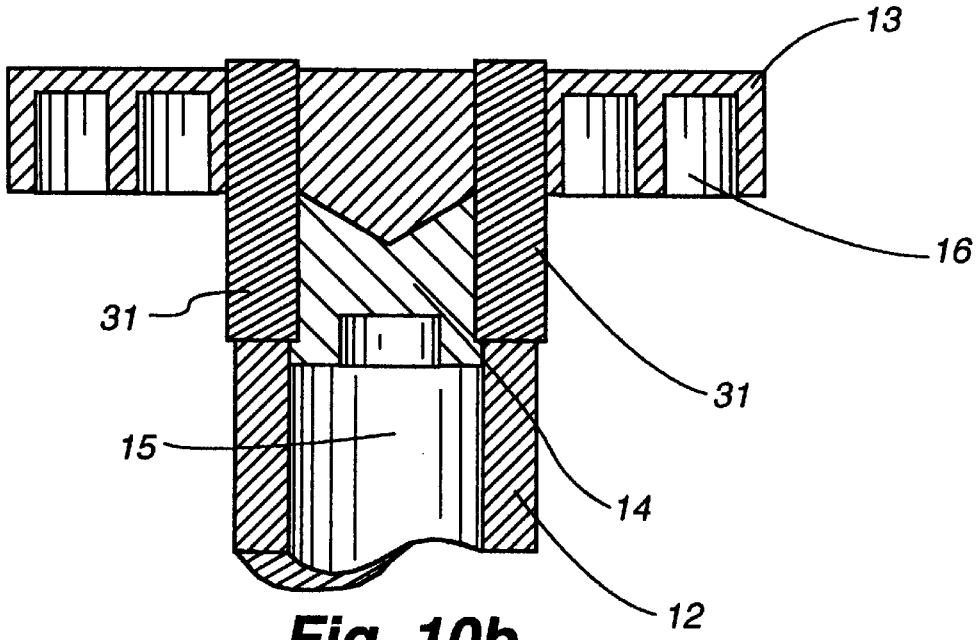
FIG. 10*a* is a top plan view and 10*b* is a cross-sectional view taken along lines 5—'5' showing an H-plane cross-section of the sub-reflector and tube where the sub-reflector and tube are connected with two thin metal plates.
Figure 10A:
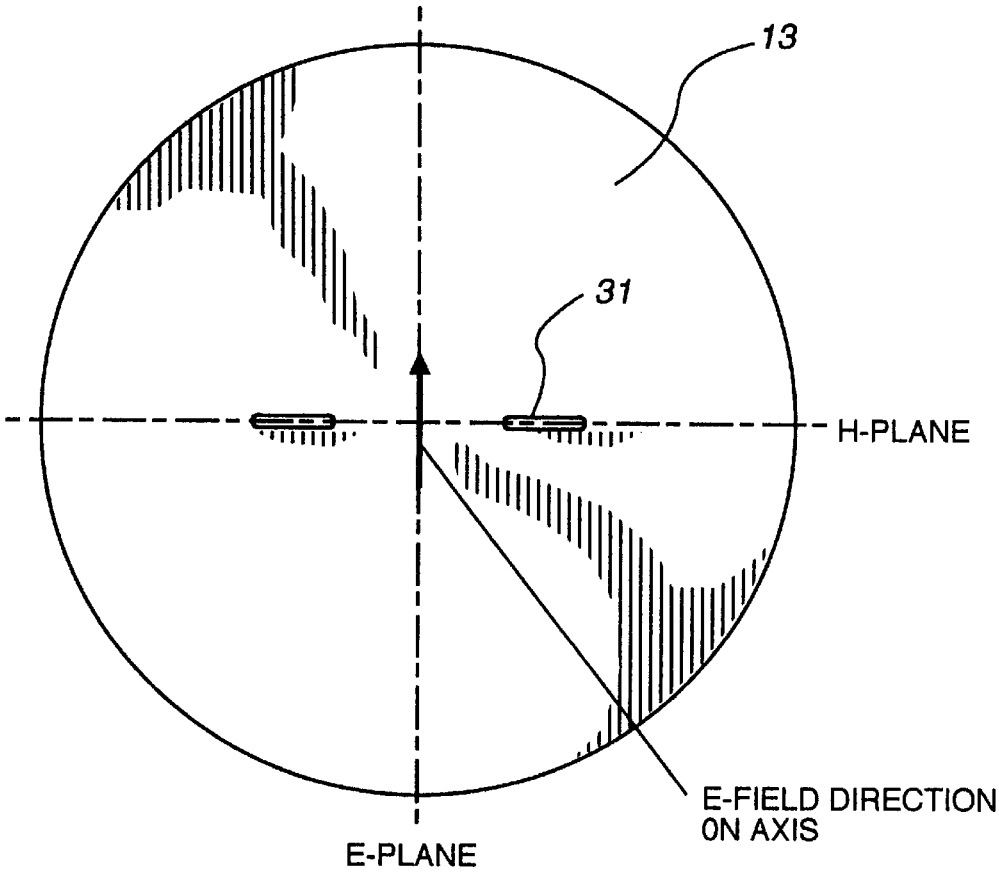

FIGS. 9*a* and *b* shows the location of two metal screws 30 which connect the sub-reflector 13 to the end of the tube 12 according to the invention. The two screws are located in H-plane where the electric field becomes orthogonal to the screws so that they have minimum effect on the performance. FIGS. 9*a* and *b* show two thin connecting plates 31 according to the invention. They are penetrating into small narrow slots in the sub-reflector and tube end, and are soldered or in other ways fastened there. These plates are also located in H-plane and are oriented in such a way that they have as small azimuthal extent as possible, causing negligible field blockage. The invention is not limited to the realizations shown. In particular, one of the screws shown in FIG. 9*b* may be removed, or more screws may be located side by side in the same H-plane. The two plates may also be combined to one plate which extends through the center of the sub-reflector and tube, or there may be more plates side by side.

Figure 11:
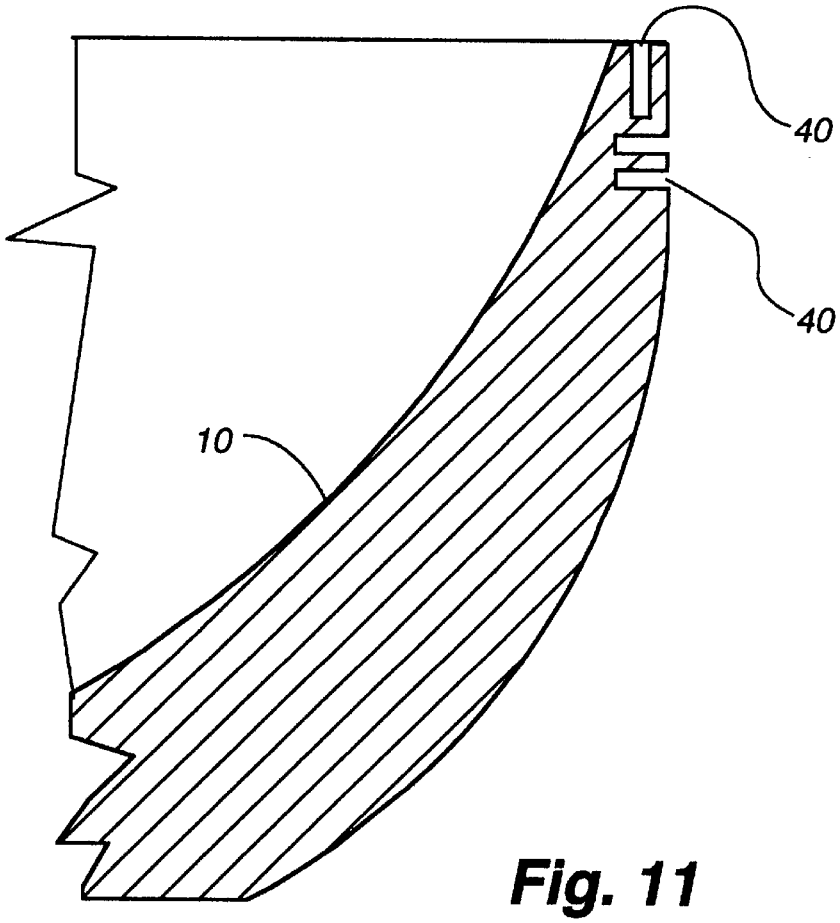
FIGS. 11–14 show an axial cross-section of the outer part of the main reflector, when the rim is provided with grooves, corrugations and metalized dielectric rings.
Figure 12:
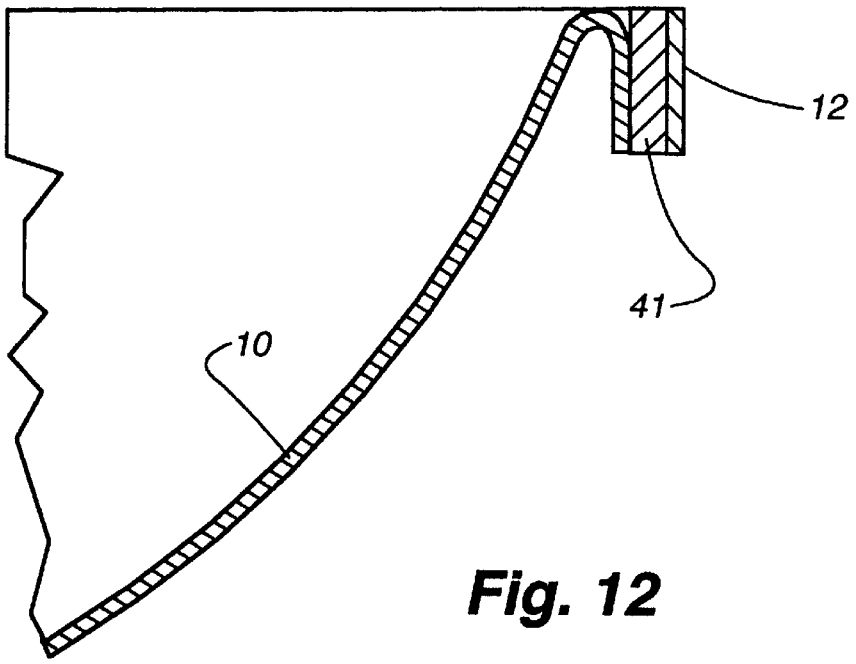
Figure 13:
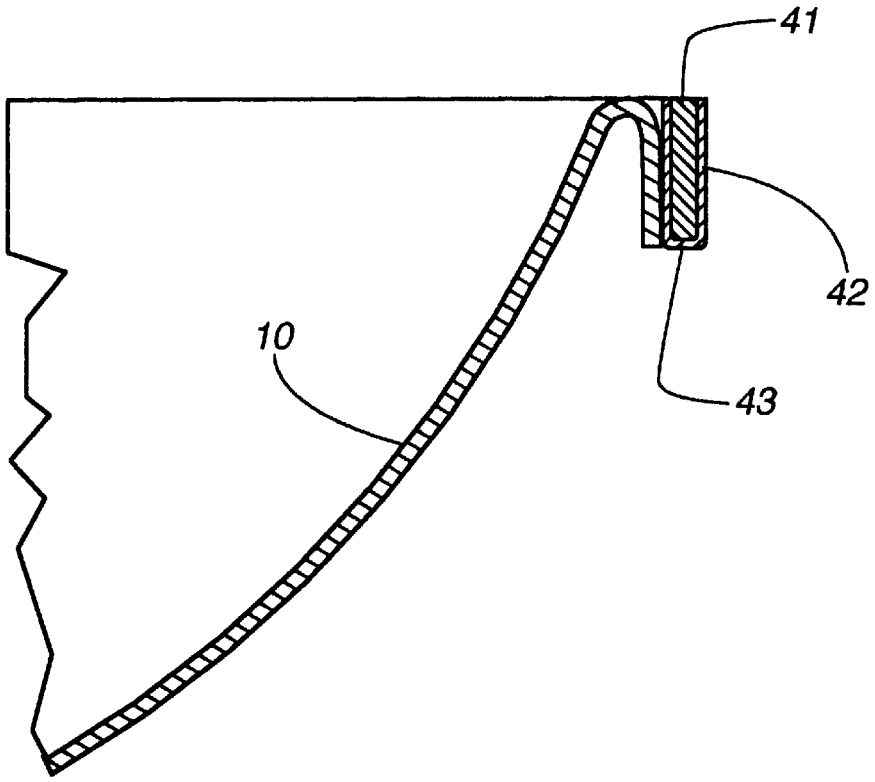
Figure 14:
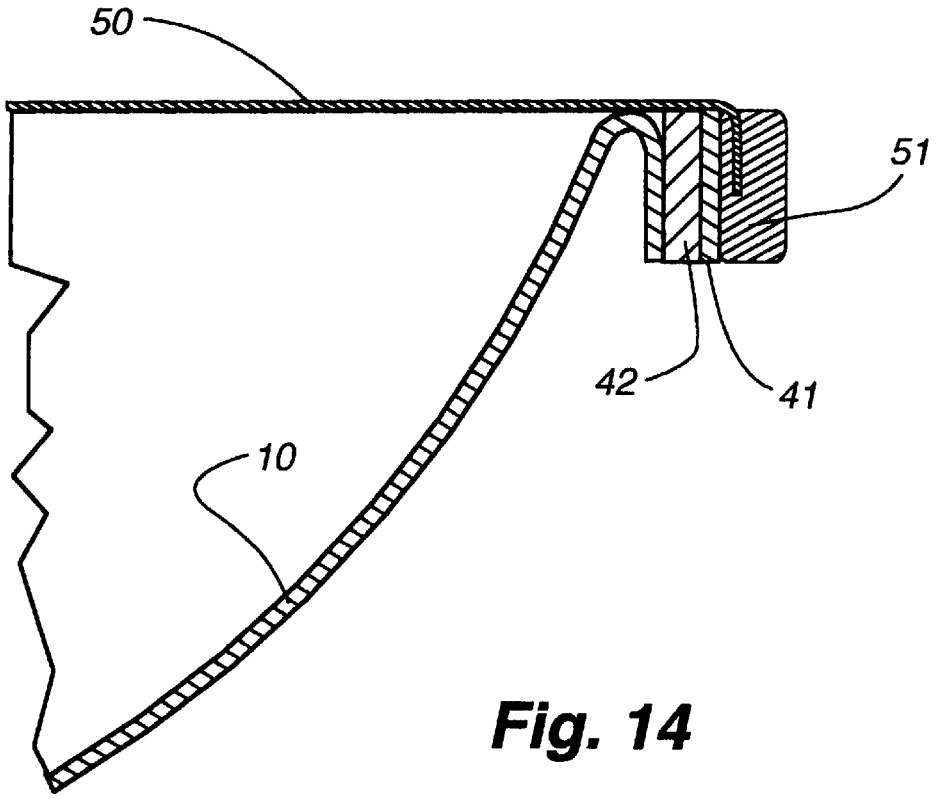

FIGS. 11–14 show four different realizations of so-called chokes near the reflector rim. The corrugations 40 in FIG. 11 are all located according to the invention, as well as each one of them. The choke in FIG. 12 is provided as a dielectric material making up a ring 41 around the reflector rim, and this has a metalized outer surface 42. The choke is in this case open-ended, and must therefore be between 0.5 and 0.75 dielectric wavelengths in order to work as a choke. In FIG. 13 the dielectric ring 41 is provided with metal even at the bottom 43. Its length should be between 0.25 and 0.5 dielectric wavelengths. The corrugations and dielectric rings can be combined with a support 51 for a radome 50 in front of the reflector. The invention is not limited to those realizations shown. In particular, there may be more dielectric rings outside each other with or without metal sheets in between them.

Figure 15:
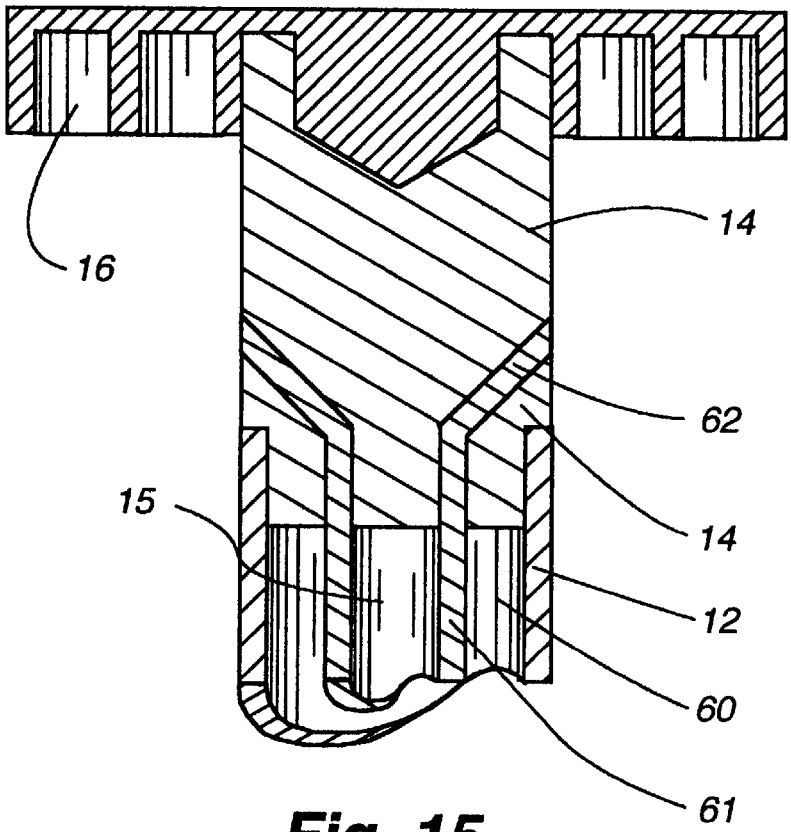
FIGS. 15–16 show axial cross-sections of two examples of feeds designed with a tube which contains both a circular waveguide and a coaxial waveguide for a dual-band operation.
Figure 16:
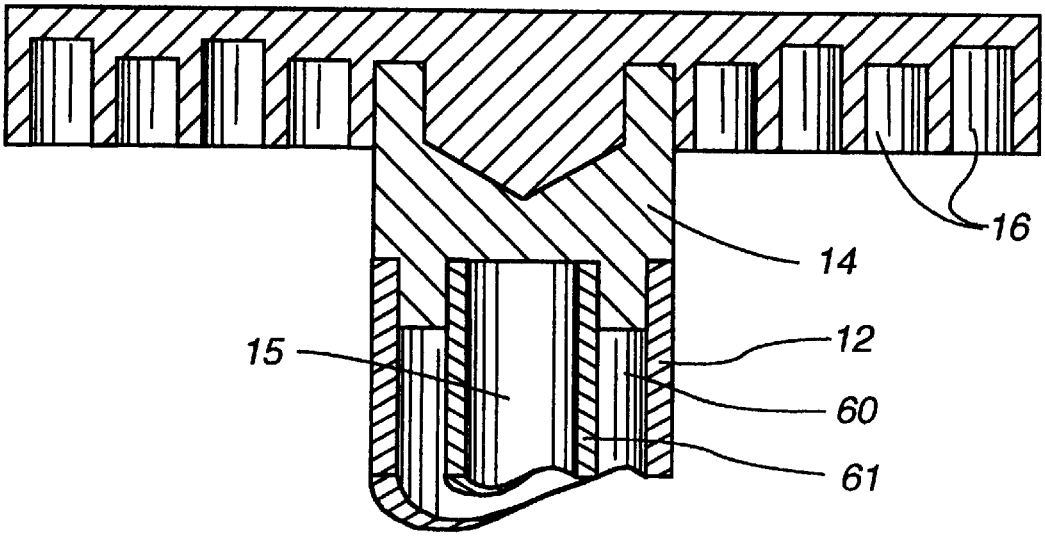

FIGS. 15–16 show two embodiments for the case that the tube 12 contains both a circular waveguide 15 and a coaxial waveguide 60. The inner circular cylinder 61 between the waveguides are made of conducting material (metal). The end of the tube, the end of the inner cylinder and the dielectric joint 14 are shaped so as to enable optimum radiation performance in both frequency bands. This is done in FIG. 15 by shaping the inner tube to a cone 62 which extends to the circumferential aperture and divides the dielectric joint in two pieces. The solution in FIG. 16 contains corrugations 16 of two different depths, in order to work optimally in both bands. The invention is not limited to the two realizations shown in FIGS. 15 and 16. E.g., the solution in FIG. 15 can have dual depth corrugations, and the solution in FIG. 16 can have metal elements inside the joint.

Figure 17:
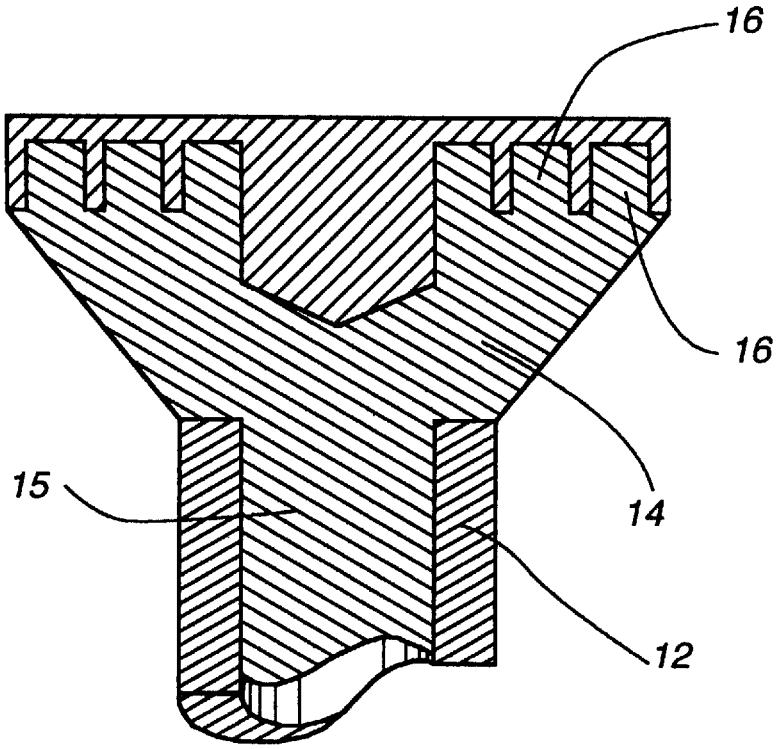
FIGS. 17–19 show axial cross-sections of various feeds designed according to the present invention.
Figure 18:
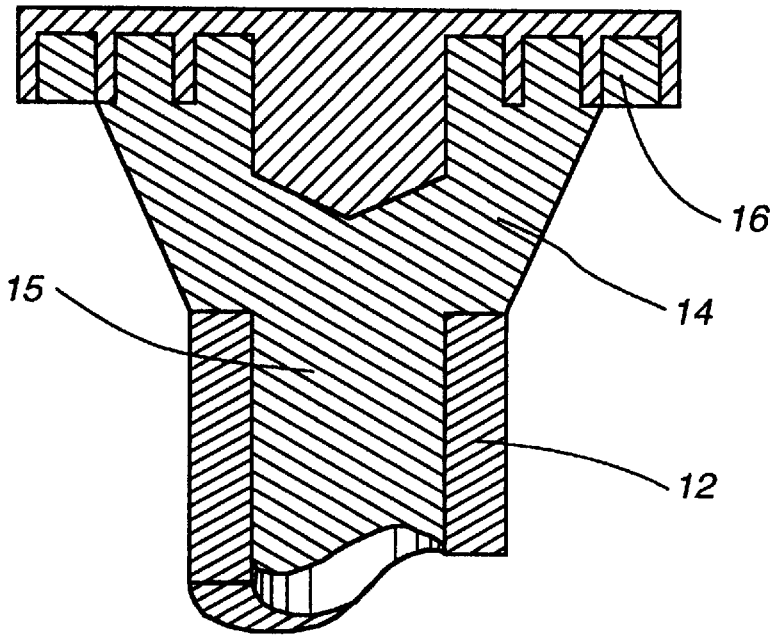
Figure 19:
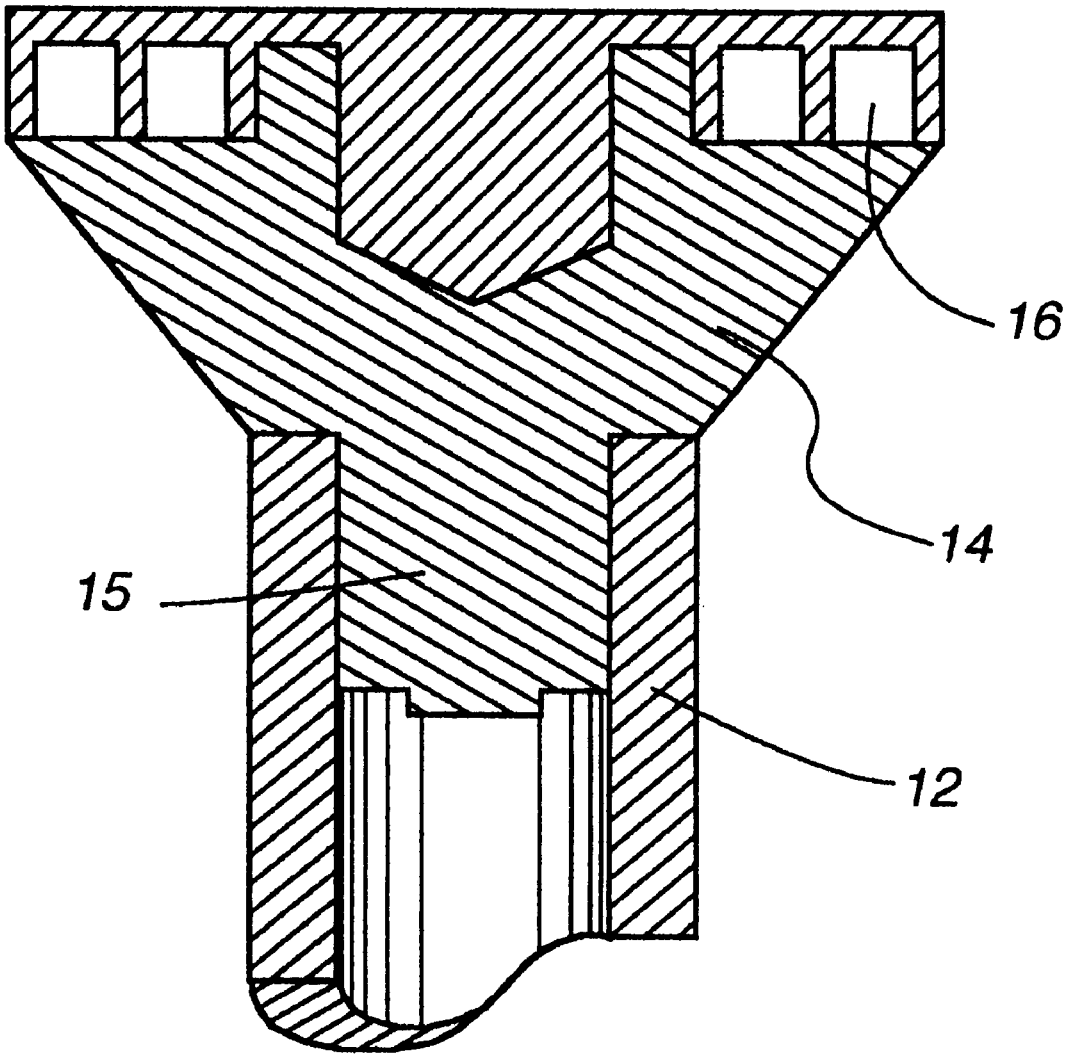

The feeds in FIGS. 17–19 have dielectric material not only in the central part of the gap between the end of the tube and the sub-reflector, but even in a region with diameter larger than the diameter of the tube and partly or completely covering the corrugations 16. The waveguide may also be entirely filled with dielectric material in some applications, in order to prevent water to build up inside the tube. The cross-section of the dielectric filling may have any shape, whereas the drawings show only three examples.

The drawings show a few different designs of the invention. It should nevertheless be apparent that there are numerous other forms of designs possible and still be within the scope of the present invention.

EXPLANATION OF PRINCIPLE OF OPERATION

The principle of operation of the antenna as described in the referenced European and U.S. patents will not be repeated here, but the improvements will be explained.

Ring Focus Reflector

The ring focus reflector works in such a way that the waves propagate a slightly different distance than in a paraboloid, in such a way that this corrects for the ellipsoidal phase fronts of the radiation field of the feed and makes the phase of the aperture field constant.

Elevated Central Region

The elevated central region of the main reflector cause a small perturbation of the reflected waves from the main reflector surface. This perturbation has the extent of the elevated region and an amplitude which is proportional to the height of the perturbation (for small heights). The radiation from the perturbation will when transformed to the aperture for certain dimensions have the same amplitude but opposite phase compared to the unperturbed aperture field. In this way it will create an interference minimum at the focal point. Many different height profiles can provide this. The perturbed reflected field corresponds to a small aperture radiating from the central reflector region. The field distribution over this aperture is proportional to the height, which means that we can control it with the height distribution. In aperture theory Gaussian aperture fields are known to give in particular low sidelobes, so also with this pertubational aperture field. Therefore, a Gaussian height profile gives lower sidelobes than a constant height profile.

Metal Screws

Metal cylinders are known to cause very little field blockage and scattering if the electric field is orthogonal to them. Metal plates are known to cause very little field blockage and scattering if the field is orthogonal to the plate and is incident from a direction in the plane of the plate. Therefore, when we locate screws and plates in H-plane as in the invention, they will have very little effect on the performance. If we located the cylinders and plates incorrectly in E-plane, they will destroy the performance of the antenna completely.

Rim Corrugations

Corrugations and grooves are often referred to as chokes or soft surfaces. In order to work properly they must be between 0.25 and 0.5 wavelengths deep. They work the best when the depth is 0.25 wavelengths and thereby transforms the electric conducting short to an open-circuit or equivalent magnetic current at the opening of the grooves. This open-circuit stops the surface currents from floating and thereby E-fields which are orthogonal to the surface cannot propagate along it. If we instead use open-ended dielectric-filled grooves, the grooves must be between 0.5 and 0.75 wavelengths deep in order to provide an open-circuit or equivalent magnetic conductor at the opening. Thus, such chokes make the E-field zero of the waves propagating in a direction orthogonal to them. This will reduce the fields diffracted around the reflector rim and thereby give lower sidelobes.

Dual Band

The dual band antennas work in the same way as the antennas described in the referenced U.S. and European patents, except that in one frequency band the radiation is excited by means of the coaxial waveguide. The region in between the sub-reflector and the end of the tube as well as this end must be designed so as to provide optimum operation in both bands.

Protected Feed

The antenna with the dielectric filling between the sub-reflector and the end of the tube works in the same way as without the filling, but it is more difficult to design because there may be present undesired resonant modes in the dielectric region. Such modes may destroy the antenna performance, but they can be partly or completely removed by reducing the volume of the dielectric filled region or designing it with air pockets or using material with low permittivity.

What is claimed is:

1. In an antenna system, a reflector and a feed element for radiating or intercepting electromagnetic waves, constructed with a main reflector, a waveguide inside a tube having a first end and a second end, said first end connected to said main reflector, a sub-reflector with circular grooves or corrugations, and a dielectric joint in the space between said sub-reflector and the second end of said waveguide tube, said main reflector having an axis of symmetry, the improvement comprising:

the main reflector which is shaped as a ring focus paraboloid according to the formula $$z = -F + \frac{1}{4F}(\rho - \rho_0)^2$$

with z the axial coordinate measured along the symmetry axis, ρ the radius coordinate measured from the axis, F the focal length of the reflector, and $\rho_O$ the radius of the ring focus, where the ring focus radius is typically between 0.5 times and 1.5 times the radius of said tube, depending on the dimensions of said sub-reflector and said joint, where the main reflector deviates from the ring focus paraboloid formula due to finite tolerances and different design methods by up to an RMS value of about 0.02 wavelengths, and where the reflector is used together with different tubes and sub-reflectors designed for different frequency bands, in which the ring focus paraboloid formula is valid with the above limitations in at least one of the frequency bands.

2. In an antenna system, a reflector and a feed element for radiating or intercepting electromagnetic waves, constructed with a main reflector, having a ring focus shape a waveguide inside a tube having a first end and a second end, said first end connected to said main reflector, a sub-reflector with circular grooves or corrugations, and a dielectric joint in the space between said sub-reflector and the second end of said waveguide tube, the improvement comprising:

an elevated region in the center of said main reflector around said tube, where said elevated region has a constant height over the ring focus main reflector shape, where in the height of the elevated region has a maximum of between 0.1 and 0.25 wavelengths over the ring focus shaped main reflector, and has a diameter of between 1.9 and 7 wavelengths dependent on the frequency and the focal length of the reflector.

3. In an antenna system, a reflector and a feed element for radiating or intercepting electromagnetic waves, constructed with a main reflector, having a ring focus shape a waveguide inside a tube having a first end and a second end, said first end connected to said main reflector, a sub-reflector with circular grooves or corrugations, and a dielectric joint in the space between said sub-reflector and the second end of said waveguide tube, the improvement comprising:

a dielectric plate in said main reflector around said tube, where the plate has a constant height over the ring focus main reflector shape where in the height of the plate has a maximum over the ring focus main reflector shape which provides a phase delay of between 70 and 180 degrees compared to when the dielectric plate is not present, and where the diameter is between 1.9 and 7 wavelengths, depending on the frequency and the focal length of the reflector.

4. In an antenna system, a reflector and a feed element for radiating or intercepting electromagnetic waves, constructed with a main reflector, a waveguide inside a tube having a first end and a second end, said first end connected to said main reflector, a sub-reflector with circular grooves or corrugations, and a dielectric joint in the space between said sub-reflector and the second end of said waveguide tube, the improvement comprising:

fastening means for creating a strong metal connection between said sub-reflector and said tube being located in a plane through the center axis of said tube and said sub-reflector and on opposite sides of this axis.

5. In an antenna system, a reflector and a feed element for radiating or intercepting electromagnetic waves, constructed with a main reflector having a rim around its outer perimeter, a waveguide inside a tube having a first end and a second end, said first end connected to said main reflector, a sub-reflector with circular grooves or corrugations, and a dielectric joint in the space between said sub-reflector and the second end of said waveguide tube, the improvement comprising:

one or more air-filled or dielectric-filled grooves, located in or around the rim of said main reflector, where the depth of these grooves are between 0.25 and 0.5 wavelengths of the material inside the groove.

6. In an antenna system, as defined in claim 5 wherein the air filled grooves are located in the rim of said main reflector.

7. In an antenna system, a reflector and a feed element for radiating or intercepting electromagnetic waves, constructed with a main reflector having a rim around its outer perimeter, a waveguide inside a tube having a first end and a second end, said first end connected to said main reflector, a sub-reflector with circular grooves or corrugations, and a dielectric joint in the space between said sub-reflector and the second end of said waveguide tube, the improvement comprising:

one or more open-ended dielectric rings which are metalized on the outermost side in such a way that they form coaxial layers of dielectric material and metal, located around the rim of said main reflector, where the depth of the open-ended dielectric-filled coaxial waveguides formed by the dielectric layers are typically between 0.5 and 0.75 wavelengths of the dielectric material.

8. In an antenna system, a reflector and a feed element for radiating or intercepting electromagnetic waves, constructed with a main reflector, a waveguide inside a tube having a first end and a second end, said first end connected to said main reflector, a sub-reflector with circular grooves or corrugations, and a dielectric joint in the space between said sub-reflector and the second end of said waveguide tube, the improvement comprising:

a cylinder, said cylinder comprising said tube and said waveguide, and having a constant thickness along its length, said cylinder being fastened to the main reflector.

9. The antenna system as defined in claim 8, further including a support plate fastened between the cylinder and the main reflector.

10. In an antenna system, a reflector and a feed element for radiating or intercepting electromagnetic waves, constructed with a main reflector, a waveguide inside a tube having a first end and a second end, said first end connected to said main reflector, a sub-reflector with circular grooves or corrugations, and a dielectric joint in the space between said sub-reflector and the second end of said waveguide tube, the improvement comprising:

an inner cylindrical tube located inside said waveguide tube such that a coaxial waveguide is formed between the outer wall of said inner tube and the inner wall of said waveguide tube, and where the dielectric joint contains metal parts which are connected to said inner tube.

11. In an antenna system, a reflector and a feed element for radiating or intercepting electromagnetic waves, constructed with a main reflector, a waveguide inside a tube having a first end and a second end, said first end connected to said main reflector, a sub-reflector with circular grooves or corrugations, and a dielectric joint in the space between said sub-reflector and the second end of said waveguide tube, the improvement comprising:

the main reflector has a paraboloidal shape and includes an elevated region in the center of said main reflector around said tube, said elevated region has a constant height above the surface of the main reflector, the elevated region has a maximum height of between 0.1 and 0.25 wavelengths, and has a diameter between 1.9 and 7 wavelengths depending upon the frequency and focal length of the reflector.

12. In antenna system as defined in claim 11, wherein the elevated region is formed by a dielectric plate.

13. In an antenna system, a reflector and a feed element for radiating or intercepting electromagnetic waves, constructed with a main reflector, a waveguide inside a tube having a first end and a second end, said first end connected to said main reflector, a sub-reflector with circular grooves or corrugations, and a dielectric joint in the space between said sub-reflector and the second end of said waveguide tube, the improvement comprising:

an elevated region in the center of said main reflector around said tube, said elevated region has a height which tapers off gradually from a maximum near the tube to zero at a radial distance from the tube, and wherein the maximum height of the elevated region is between 0.1 and 0.25 wavelengths and the diameter at the point where the height is reduced to 0.37 of its maximum value is between 1.9 and 7 wavelengths, depending upon the frequency and the focal length of the reflector.

14. In an antenna system as defined in claim 13, wherein the main reflector has a paraboloidal shape.

15. In an antenna system as defined in claim 13, wherein the main reflector has a ring focus shape.

16. In an antenna system, a reflector and a feed element for radiating or intercepting electromagnetic waves, constructed with a main reflector, a waveguide inside a tube having a first end and a second end, said first end connected to said main reflector, a sub-reflector with circular grooves or corrugations, and a dielectric joint in the space between said sub-reflector and the second end of said waveguide tube, said main reflector having an axis of symmetry, the improvement comprising:

the main reflector has a paraboloidal shape and includes an elevated region in the center of said main reflector around said tube, said elevated region has a flat planar surface which is perpendicular to the axis of symmetry of the main reflector, the flat elevated region has a maximum height of between 0.1 and 0.25 wavelengths and has a diameter between 1.9 and 7 wavelengths depending upon the frequency and the focal length of the reflector.

17. In an antenna system, a reflector and a feed element for radiating or intercepting electromagnetic waves, constructed with a main reflector, a waveguide inside a tube having a first end and a second end, said first end connected to said main reflector, a sub-reflector with circular grooves or corrugations, and a dielectric joint in the space between said sub-reflector and the second end of said waveguide tube, said main reflector having an axis of symmetry, the improvement comprising:

an elevated region in the center of said main reflector around said tube, a dielectric plate forms the elevated region in the center of said main reflector around said tube, said dielectric plate tapers off gradually from a maximum height near the tube to 0 at a radial distance away from the tube, and where the maximum height of the plate provides a phase delay in the associated electromagnetic waves between 70 and 180 degrees compared to when the dielectric plate is not present, and the diameter at the point where the height is reduced to 0.37 of its maximum value is between 1.9 and 7 wavelengths, depending upon the frequency and the focal length of the reflector.

18. In an antenna system as defined in claim 17, wherein the main reflector has a paraboloidal shape.

19. In an antenna system as defined in claim 17, wherein the main reflectors has a ring focus shape.

20. In an antenna system, a reflector and a feed element for radiating or intercepting electromagnetic waves, constructed with a main reflector, a waveguide inside a tube having a first end and a second end, said first end connected to said main reflector, a sub-reflector with circular grooves or corrugations, and a dielectric joint in the space between said sub-reflector and the second end of said waveguide tube, the improvement comprising:

an elevated region in the center of said main reflector around said tube, said elevated region has a constant height above the surface of the main reflector, the elevated region having a maximum height of between 0.1 and 0.25 wavelengths and has a diameter between 1.9 and 7 wavelengths depending upon the frequency and the focal length of the reflector.

21. In an antenna system, a reflector and a feed element for radiating or intercepting electromagnetic waves, constructed with a main reflector having a rim around its outer perimeter, a waveguide inside a tube having a first end and a second end, said first end connected to said main reflector, a sub-reflector with circular grooves or corrugations, and a dielectric joint in the space between said sub-reflector and the second end of said waveguide tube, the improvement comprising:

one or more dielectric rings are provided having metalized outer and bottom surfaces, said dielectric rings effectively forming a dielectric-filled groove located around the rim of said main reflector, where the depth of these grooves are between 0.25 and 0.5 wavelengths of the material inside the grooves.

22. In an antenna system, a reflector and a feed element for radiating or intercepting electromagnetic waves, constructed with a main reflector having a rim around its outer perimeter, a waveguide inside a tube having a first end and a second end, said first end connected to said main reflector, a sub-reflector with circular grooves or corrugations, and a dielectric joint in the space between said sub-reflector and the second end of said waveguide tube, the improvement comprising:

one or more dielectric rings are provided having metalized outer surfaces and being located around the rim of said main reflector, the width of the rings when measured in the axial direction of the reflector are between 0.50 and 0.75 wavelengths of the material inside the grooves.

23. In an antenna system, as defined in claim 22 wherein the dielectric-filled grooves are located in the rim of said main reflector.

24. In an antenna system, a reflector and a feed element for radiating or intercepting electromagnetic waves, constructed with a main reflector having a rim around its outer perimeter, a waveguide inside a tube having a first end and a second end, said first end connected to said main reflector, a sub-reflector with circular grooves or corrugations, and a dielectric joint in the space between said sub-reflector and the second end of said waveguide tube, the improvement comprising:

a plurality of dielectric rings having metal film positioned between the rings so as to form coaxial layers of dielectric material and metal, and said dielectric rings are located around the rim of said main reflector.

25. In an antenna system as defined in claim 24 wherein the dielectric rings are located in the rim of said main reflector.

26. In an antenna system, a reflector and a feed element for radiating or intercepting electromagnetic waves, constructed with a main reflector having a rim around its outer perimeter, a waveguide inside a tube having a first end and a second end, said first end connected to said main reflector, a sub-reflector with circular grooves or corrugations, and a dielectric joint in the space between said sub-reflector and the second end of said waveguide tube, said main reflector having an axis of symmetry, the improvement comprising:

the main reflector includes an elevated region in the center of said main reflector around said tube, said elevated region has a flat planar surface which is perpendicular to the axis of symmetry of the main reflector, the flat elevated region has a maximum height of between 0.1 and 0.25 wavelengths and has a diameter between 1.9 and 7 wavelengths depending upon the frequency and the focal length of the reflector.

27. In an antenna system as described in claim 26, wherein the main reflector has a ring focus shape.

28. In an antenna system, a reflector and a feed element for radiating or intercepting electromagnetic waves, constructed with a main reflector, a waveguide inside a tube having a first end and a second end, said first end connected to said main reflector, a sub-reflector with circular grooves or corrugations, and a dielectric joint in the space between said sub-reflector and the second end of said waveguide tube, the improvement comprising:

an elevated region in the center of said main reflector around said tube, said elevated region being formed by a dielectric plate, said dielectric plate having a constant height above the surface of the main reflector, said dielectric plate having a maximum height of between 0.1 and 0.25 wavelengths and having a diameter between 1.9 and 7 wavelengths depending upon the frequency and the focal length of the reflector.

29. In an antenna system as defined in claim 28, wherein the main reflector has a ring focus shape.

30. In an antenna system as defined in claim 28, wherein the main reflector has a paraboloidal shape.

31. In an antenna system, a reflector and a feed element for radiating or intercepting electromagnetic waves, constructed with a main reflector having a rim around its outer perimeter, a waveguide inside a tube having a first end and a second end, said first end connected to said main reflector, a sub-reflector with circular grooves or corrugations, and a dielectric joint in the space between said sub-reflector and the second end of said waveguide tube, the improvement comprising:

an inner cylindrical tube located inside said waveguide tube such as that a coaxial waveguide is formed between the outer wall of said inner tube and the inner wall of said waveguide tube, and where the dielectric joint contains metal parts which are not connected to said inner tube.

* * * * *